US011431087B2

(12) United States Patent
Guthrie et al.

(10) Patent No.: US 11,431,087 B2
(45) **Date of Patent: *Aug. 30, 2022**

(54) WIDEBAND, LOW PROFILE, SMALL AREA, CIRCULAR POLARIZED UHF ANTENNA

(71) Applicant: R.A. Miller Industries, Inc., Grand Haven, MI (US)

(72) Inventors: Warren Guthrie, West Olive, MI (US); Eric Emens, Grand Haven, MI (US); John Jeremy Churchill Platt, Grand Haven, MI (US); Roger Cox, Spring Lake, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/061,690

(22) Filed: Oct. 2, 2020

(65) Prior Publication Data

US 2021/0021021 A1 Jan. 21, 2021

Related U.S. Application Data

(62) Division of application No. 15/918,598, filed on Mar. 12, 2018, now Pat. No. 10,862,198.

(60) Provisional application No. 62/470,931, filed on Mar. 14, 2017.

(51) Int. Cl.

| | |
|---|---|
| ***H01Q 1/28*** | (2006.01) |
| ***H01Q 11/08*** | (2006.01) |
| ***H01Q 9/04*** | (2006.01) |
| ***H01Q 21/00*** | (2006.01) |

(52) U.S. Cl.
CPC ..... *H01Q 1/282* (2013.01); *H01Q 9/0428* (2013.01); *H01Q 11/08* (2013.01); *H01Q 21/0025* (2013.01)

(58) Field of Classification Search
CPC ..... H01Q 1/282; H01Q 1/3275; H01Q 1/42; H01Q 3/30; H01Q 9/0428; H01Q 11/08; H01Q 15/008; H01Q 21/0025; H01Q 21/26
See application file for complete search history.

(56) References Cited

U.S. PATENT DOCUMENTS

| | | | | |
|---|---|---|---|---|
| 5,650,792 | A | 7/1997 | Moore | |
| 6,897,813 | B2 | 5/2005 | Higasa | |
| 6,906,674 | B2 * | 6/2005 | McKinzie, III | H01Q 15/008 343/700 MS |
| 6,909,400 | B2 | 6/2005 | Vothknecht | |
| 8,188,928 | B2 | 5/2012 | Ilin | |
| 8,884,834 | B1 | 11/2014 | Paschen | |
| 9,281,570 | B2 | 3/2016 | Alexopoulos | |
| 9,431,709 | B2 * | 8/2016 | McKinzie, III | H01Q 9/285 |
| 9,502,761 | B2 | 11/2016 | Itoh | |
| 9,572,512 | B2 | 2/2017 | Weinstein | |

(Continued)

FOREIGN PATENT DOCUMENTS

EP 1353406 A1 10/2003

*Primary Examiner* — Hoang V Nguyen
(74) *Attorney, Agent, or Firm* — McGarry Bair PC

(57) ABSTRACT

An antenna assembly includes a circularly polarized antenna housing configured to mount to a mounting surface. The antenna assembly also includes a vertical antenna housing having a first end proximate to the circularly polarized antenna housing, as well as a distal end extending normally from the circularly polarized antenna housing.

9 Claims, 17 Drawing Sheets

(56) References Cited

U.S. PATENT DOCUMENTS

| | | | | |
|---|---|---|---|---|
| 9,590,314 | B2 | 3/2017 | Celik | |
| 2004/0021606 | A1 | 2/2004 | Shigihara | |
| 2007/0139294 | A1 | 6/2007 | Dunn | |
| 2008/0055171 | A1* | 3/2008 | Noro | H01Q 1/3275 343/715 |
| 2015/0263426 | A1 | 9/2015 | Hsu | |
| 2015/0270622 | A1 | 9/2015 | Takasaki | |
| 2018/0054002 | A1* | 2/2018 | Cox | H01Q 1/42 |

* cited by examiner

WIDEBAND, LOW PROFILE, SMALL AREA, CIRCULAR POLARIZED UHF ANTENNA

CROSS-REFERENCE TO RELATED APPLICATION(S)

This application is a Divisional Patent Application of U.S. patent application Ser. No. 15/918,598, filed Mar. 12, 2018, now U.S. Pat. No. 10,862,198, which claims priority to U.S. Provisional Patent Application No. 62/470,931, filed Mar. 14, 2017, both of which are incorporated herein by reference in their entirety.

BACKGROUND

Circular polarization (CP) is commonly used for satellite communication (SATCOM) and for improving consistency of radio frequency (RF) propagation to terrestrial and airborne terminals. A SATCOM antenna is often elevated above an aircraft body by a significant distance, which is a major cause of high drag forces. Since space for antennas is limited, it is known for antenna housings to include multiple individual antennas. For example, the region between a SATCOM antenna and an aircraft body may be occupied by a vertically polarized antenna in the support structure that serves as a housing for the vertical antenna.

FIG. 1 illustrates a prior art antenna assembly 10. The antenna assembly 10 includes a mounting surface 12, such as a wall. A vertical housing 14 having a height 16 can be coupled to the mounting surface 12 for housing a vertically polarized antenna 15. A circular housing 18 can be coupled to the vertical housing 14 for housing a circularly-polarized antenna 19, such as a SATCOM antenna. It can be appreciated that the circular SATCOM antenna housing 18 in the example of FIG. 1 is spaced apart from the mounting surface 12 by the height 16 as shown. In one non-limiting example, the height is typically 12 inches.

There remains a need to further reduce the profile of a SATCOM antenna and locate it proximate to an aircraft skin.

DESCRIPTION OF EMBODIMENTS

Figure 1:
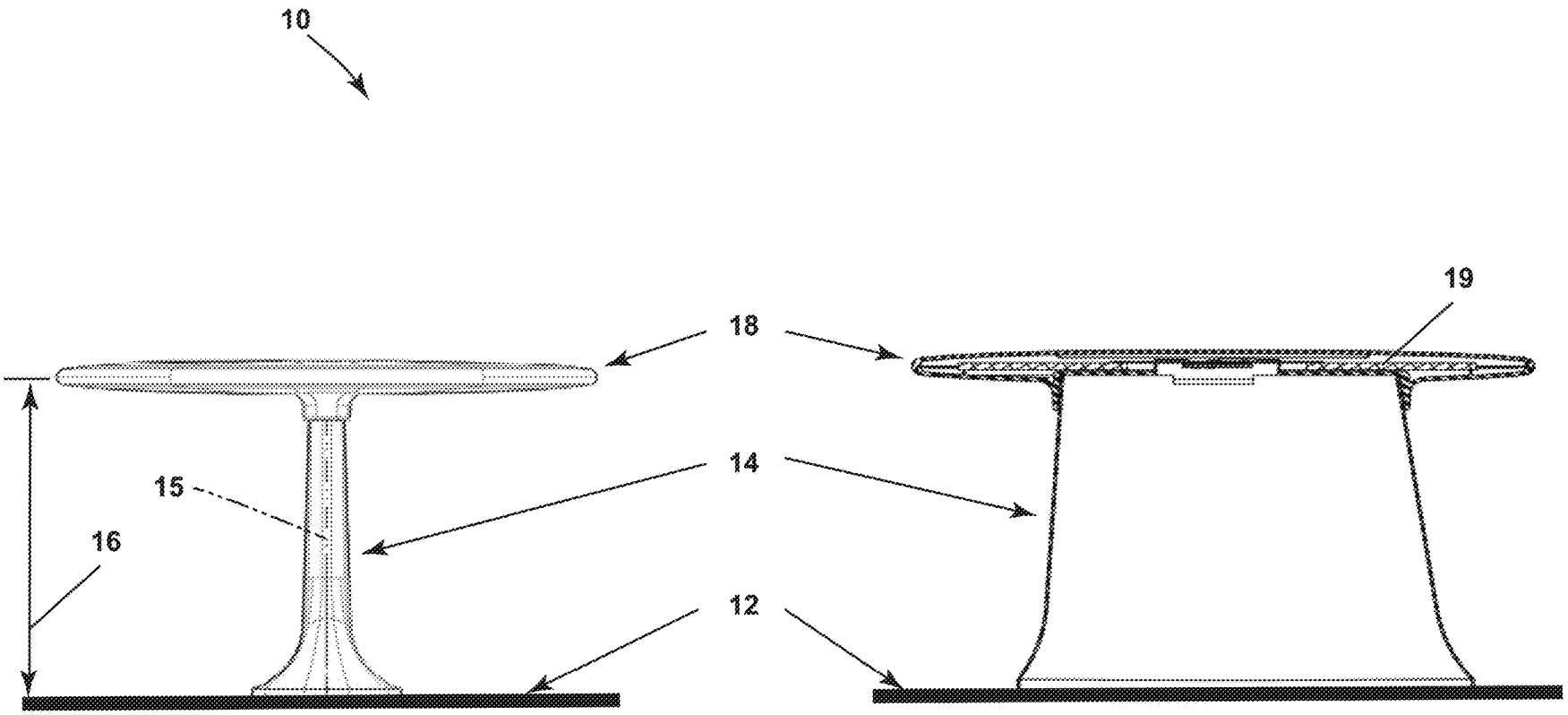
FIG. 1 Prior Art
FIG. 1 is a schematic view of a prior art antenna assembly from a front view and a side view.

Aspects of the present disclosure are broadly directed to a circularly polarized antenna. For the purposes of illustration, the circularly polarized antenna will be described in the context of an aircraft environment. However, the disclosure is not so limited and can have general applicability in a variety of environments.

As used herein, a set of commonly referred to vectors will be used to describe orientation, where +Z is the intended direction of signal propagation, −Z is opposite to the intended direction of travel, and wherein X and Y are orthogonal to each other and to Z. Electric fields are established in the X/Y plane and propagation is in the Z direction. Circular polarization is produced when two orthogonal electric fields are produced with a 90 degree phase shift.

Circularly polarized antennas have certain ideal electrical characteristics, as summarized in Table 1 below:

TABLE 1

| Characteristic | Ideal |
|---|---|
| Operating Bandwidth | As wide as possible |
| Low Radiation in Unintended Direction (backlobe) | As low as possible (typically 10 dB less than in the intended direction) |
| Low Axial Ratio | 1 (or 0 dB) |
| Low Antenna Height | As low as possible |

There are several commonly-used methods for producing orthogonal electric fields. In one example, a structure such as a patch can be oriented in the X-Y plane and include two electromagnetic modes with a 90 degree phase shift (e.g. a patch antenna). In such a case, the patch has a very narrow useful bandwidth (typically 10 percent or less). As used herein, a "useful" bandwidth is defined by or characterized by a range of frequencies over which an antenna can operate properly, such as a frequency range wherein an antenna exhibits a radiation efficiency greater than 70%. Useful bandwidth can also be described in another example in terms of a percentage of a center frequency of the band as shown in Equation 1:

$$\text{Bandwidth} = 100 \times \frac{f_H - f_L}{f_H}$$

where $f_H$ is the highest useful frequency and $f_L$ is the lowest useful frequency. In some cases, the required bandwidth for a SATCOM antenna may be very wide, for example greater than 50%. However, existing design methods can require substantial height to achieve wide bandwidth. Further, many existing CP antenna designs exhibit highly compromised performance in the form of high axial ratio, such as greater than 3 dB.

In another example, a helical wire can be oriented in the direction of propagation (e.g. a helix antenna). The helical wire in such an example is naturally quite tall, e.g. 1 wavelength or more. In yet another example, four helical filaments can be fed with 90 degree phase offsets (e.g. a quadrafilar antenna). The quadrafilar antenna also has a tall construction, typically $\frac{1}{4}^{th}$- to ½-wavelength. In still another example, apertures can be utilized such as a crossed slot with cavity backing. Such apertures generally require a substantial depth behind the 'face' of the antenna, typically $\frac{1}{4}^{th}$-wavelength or more. It can be appreciated that the aforementioned examples are not suitable for wideband and low-profile applications.

Another method for producing orthogonal electric fields includes utilizing crossed dipoles. In free space, crossed dipoles result in propagation of circularly-polarized signals in both the +Z and −Z directions. As such, signals propagating in the −Z direction can cause unwanted radiation patterns, also known as backlobe radiation. A structure can be placed behind a crossed-dipole CP antenna to control radio propagation in the −Z direction. In one example, a radio-frequency-absorbing surface can be positioned behind the crossed dipoles (i.e. in the −Z direction), such as a material with a distributed resistive content. This configuration can result in wideband absorption, as waves traveling in the −Z direction dissipate into the resistive material. However, this configuration can also result in approximately 50% energy losses, and dipole impedance can also be adversely affected resulting in further loss of power. In another example, a highly conductive surface (also known as a perfect electrical conductor, or PEC) can be positioned behind the antenna. PECs reflect waves with a 180 degree phase shift, and this configuration can be highly effective in reducing radiation in the undesired−Z direction. For optimum efficiency, the PEC should be positioned $\frac{1}{4}^{th}$-wavelength behind the crossed dipoles, resulting in an antenna that is undesirably tall. A dielectric material can also be positioned between the PEC and the dipoles, allowing the separation to be reduced, typically to $\frac{1}{10}^{th}$-wavelength; however, this configuration can cause the operating frequency to change, as well as reducing the usable bandwidth of the antenna due to a more rapidly-changing input impedance of the crossed dipoles.

In still another example, an electronic bandgap (EBG) material can be positioned behind the crossed-dipole antenna. EBG materials typically include repeating patterns of conductors, air, and dielectrics. The repeating patterns cause a reflection phase from the surface to be approximately 0 degrees, and as such, the EBG material can be placed very near to the dipoles and cause constructive interference. However, EBG materials typically exhibit low bandwidths where the reflection coefficient is near 0 degrees so the percent usable bandwidth is relatively small.

Embodiments of the disclosure relate to a circularly polarized (CP) antenna having a low physical profile, low backlobe radiation, and wide bandwidth. Non-limiting aspects of the disclosure include positioning a vertically polarized antenna above a circularly polarized SATCOM antenna, providing for an antenna assembly with lower drag and less wind loading.

As used herein "a set" can include any number of the respectively described elements, including only one element. Additionally, all directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the present disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Figure 2:
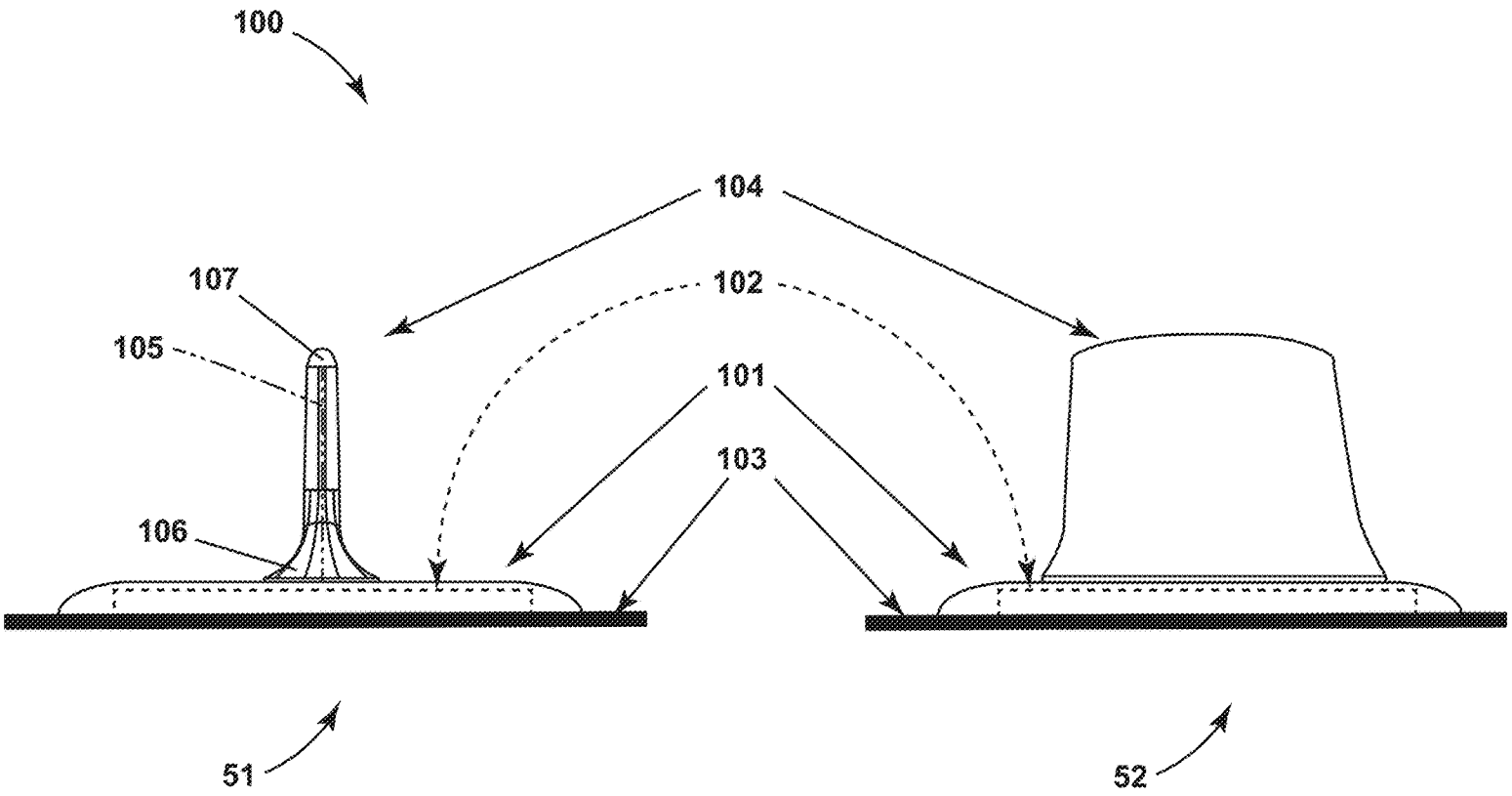
FIG. 2 is a schematic view of an antenna assembly from a front view and side view, including an exemplary circularly polarized antenna in accordance with various aspects described herein.

Turning to FIG. 2, an antenna assembly 100 of the present disclosure is illustrated according to various aspects described herein shown from a front view 51 and a side view 52. The antenna assembly 100 includes a CP antenna housing 101 (herein also referred to as "CP housing 101") which houses a low-profile, circularly polarized antenna 102 (herein also referred to as a CP antenna 102). The CP housing 101 can be configured to mount to a mounting surface 103, such as a vehicle or aircraft body or exterior wall in non-limiting examples. The antenna assembly 100 can further include a vertical antenna housing 104 (herein a "vertical housing 104") containing a vertically-polarized antenna 105 (herein a "vertical antenna 105") and set above the CP housing 101. The vertical housing 104 can include a first end 106 proximate to the CP housing 101, as well as a distal end 107 extending normally from the CP housing 101. In addition, the vertical housing 104 can be spaced opposite of the mounting surface 103 by the CP housing 101.

Figure 3:
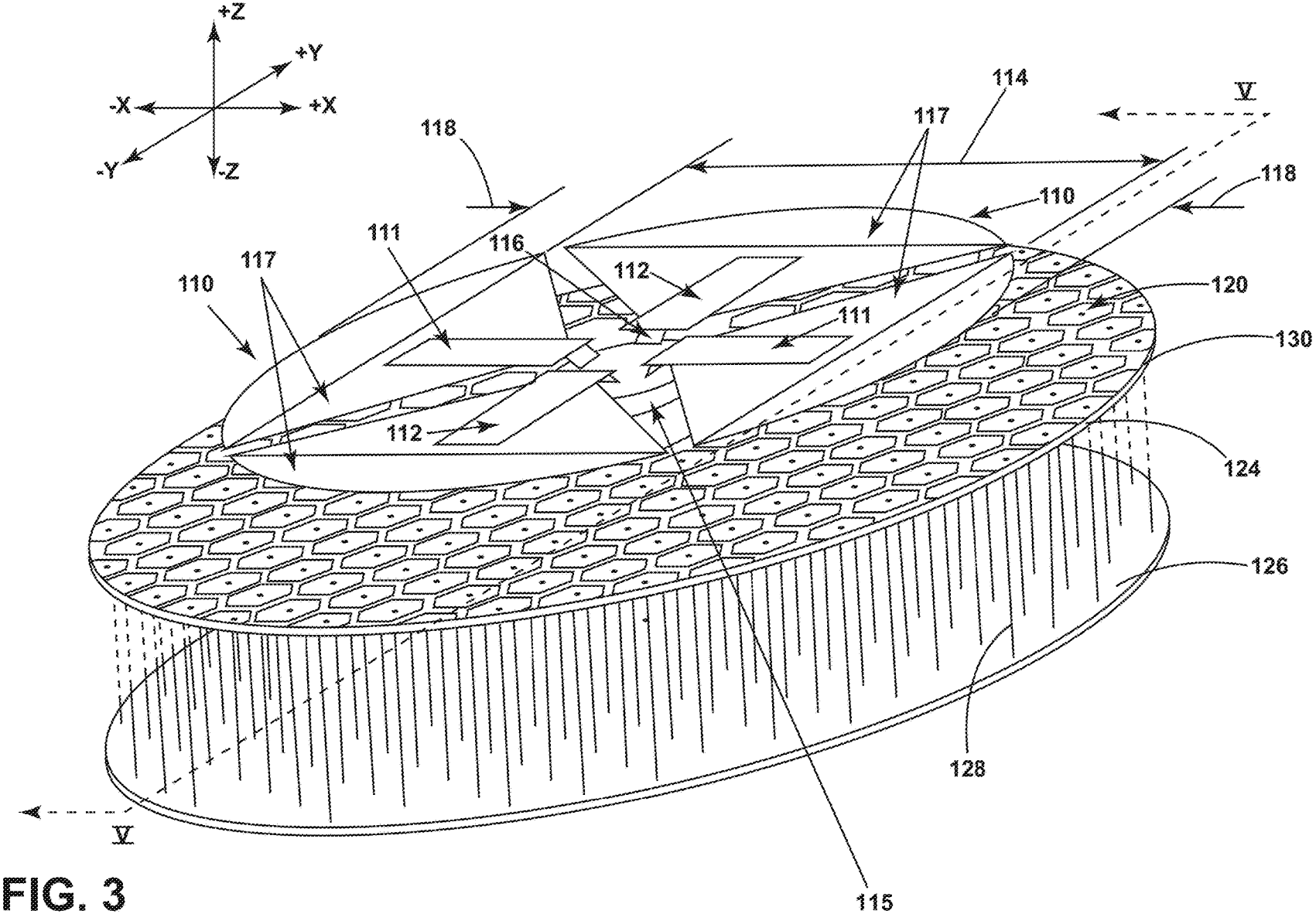
FIG. 3 is an isometric view of the circularly polarized antenna of FIG. 2 including a reactive impedance surface (RIS).

FIG. 3 illustrates the CP antenna 102 in further detail, where the CP housing 101 of FIG. 2 has been omitted for clarity. The CP antenna 102 can be a circularly polarized antenna assembly 102 having a set of radiators, illustrated as four radiators 110 in an X-Y planar, orthogonal-crossed-dipole configuration. The radiators 110 include a first dipole 111 oriented in the X-direction and a second dipole 112 oriented in the Y-direction. In a non-limiting example, the crossed dipoles 111, 112 can each have a dipole length 114 of 230 mm or less. The dipoles 111, 112 can also be connected to a feed structure 115 by way of interface connections 116 (illustrated as tabular structures). The feed structure 115 can be any type suitable for the environment and enabling or operably providing typical antenna feed capabilities. The feed structure 115 can feed the crossed dipoles 111, 112 with signals that are out of phase by 90 degrees. In the example of FIG. 3, the radiators 110 further include a support layer 117 upon which the dipoles 111, 112 can be positioned, where the support layer 117 can have a width 118 such as 350 mm in one non-limiting example. It should be understood that any portion of the radiators 110 can radiate, including the dipoles 111, 112 and the support layer 117.

The CP antenna 102 can further include a high-impedance surface, illustrated herein as a reactive impedance surface (RIS) 120 as described above and spaced apart from the radiators 110. The RIS 120 can include a generally circular profile with a substrate layer 124, and be connected to a conductive surface such as a conductive sheet 126 via conductive material such as a parallel-oriented set of metal wires or metal posts 128. A set of conductive patches 130 can be positioned in a repeating pattern over the substrate layer 124 of the RIS 120. The patches 130 are illustrated as hexagonal, and it will be understood that any desired geometry is contemplated for use, including square, rounded, octagonal, irregular, or the like, or any combination thereof. Thus the CP antenna 102 can include a set of conductive hexagonal surfaces spaced from one another by non-conductive segments.

It is contemplated that the substrate layer 124 and conductive sheet 126 each can be formed from a printed circuit board (PCB), where the patches 130 can be etched in a hexagonal pattern into the substrate layer 124. The patches 130 can be further be conductively connected to the conductive sheet 126 via the set of metal posts 128. In one example, each patch 130 can be connected via a respective metal post 128. It should be understood that the RIS 120 can act similarly to EBG material, where one difference is that the reflection phase is offset from 0 degrees, such as by +20 degrees in one non-limiting example. It is also contemplated that the support layer 117, RIS 120, and conductive sheet 126 can each be formed with a circular or cylindrical geometric profile, or with similar geometries regardless of the specific profile chosen (such as both square, or both rounded). Furthermore, the radiators 110 can have nearly the same planar area as the RIS 120, such as 75% of the area of the RIS 120 in a non-limiting example.

Figure 4:
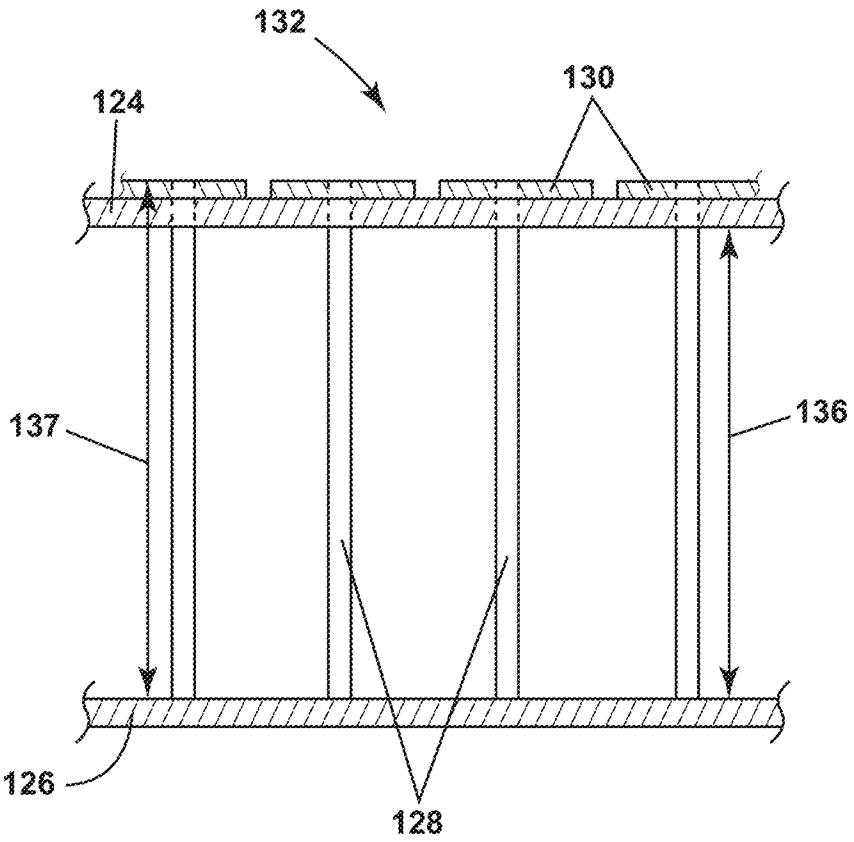
FIG. 4 illustrates a partial top view and a partial side view of the RIS of FIG. 3.
Figure 4:
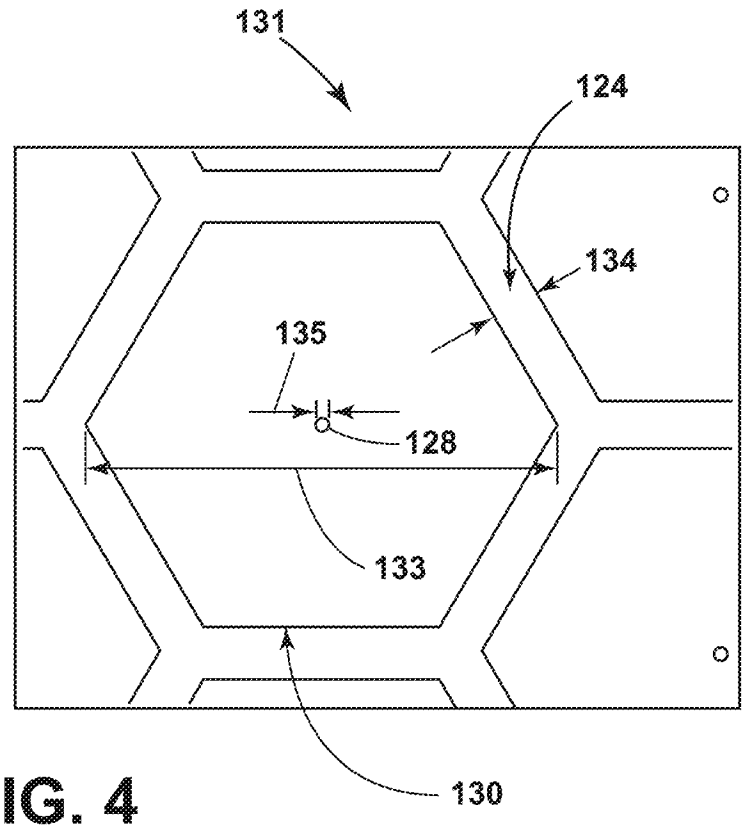

FIG. 4 illustrates portions of the RIS 120 in further detail. A first view 131 illustrates that a patch 130 can include a patch length 133, and that adjacent patches 130 can be separated by a spacing distance 134 over the substrate layer 124. In non-limiting examples, the patch length 133 can be 33 mm, and the spacing distance 134 can be 4 mm or smaller. The metal post 128 can have a diameter 135, such as 1 mm or smaller.

The patches 130 generally contain a low surface electric field as their metal surface naturally suppresses electric fields, whereas fields are allowed in gaps between adjacent patches 130 (i.e. within the spacing distance 134). Gaps near the center of the RIS 120 generally have stronger electric fields due to excitation by the radiators 110, while gaps near the perimeter of the RIS 120 generally have weaker electric fields due to the naturally high impedance of the RIS preventing currents from flowing from the center toward the edge.

A second view 132 illustrates a partial side view of the RIS 120. The substrate layer 124 and conductive sheet 126 can be separated by a layer distance 136, such as 47 mm. It can be appreciated that the metal posts 128 can separate the RIS 120 and conductive sheet 126 by the layer distance 136. In addition, the patches 130 can be separated from the conductive sheet 126 by a patch distance 137, such as 48 mm. The metal posts 128 can extend from the patches 130 perpendicularly between the substrate layer 124 and conductive sheet 126. It will be understood that all such dimensions are exemplary and can be adjusted based on environment, tuning, or desired application.

Figure 5:
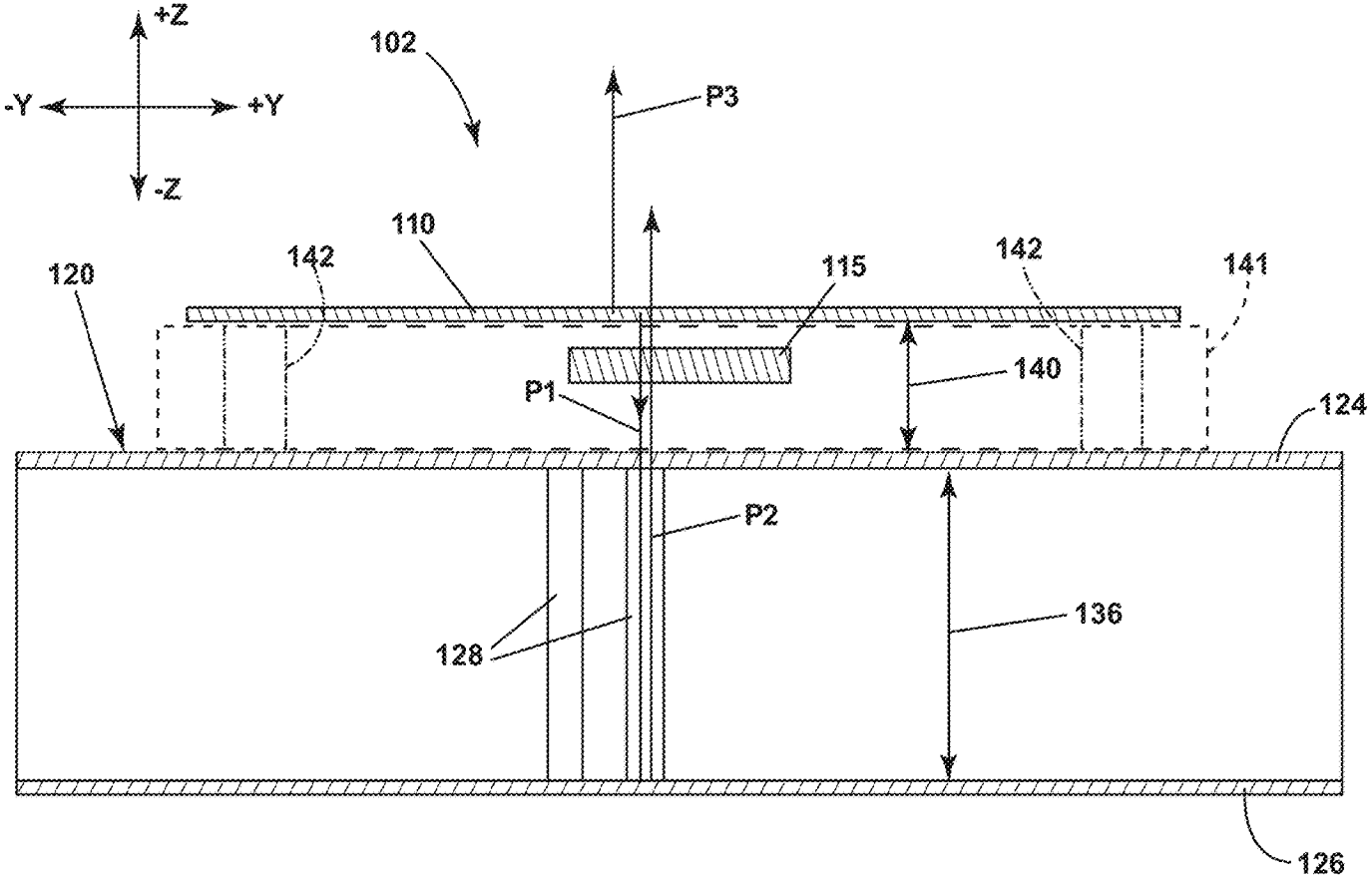
FIG. 5 is a cross-sectional view of the circularly polarized antenna, taken along view V-V of FIG. 2.

Referring now to FIG. 5, a cross-sectional view of the CP antenna 102 including the RIS 120 is shown. The RIS 120 can be positioned behind (i.e. in the −Z direction) the radiators 110 and separated therefrom by a gap distance 140, such as 20 mm in a non-limiting example. The feed structure 115 can be positioned between the radiators 110 and RIS 120, such as halfway between, or closer to the radiators 110 as illustrated. In one example, the RIS 120 can be separated via air from the radiators 110. In another example, a dielectric with a known constant $D_k$ can completely fill the space between the RIS 120 and the radiators 110 (illustrated by the dashed outline 141). In still another example, a dielectric with known constant can partially fill the space between the RIS 120 and radiators 110, illustrated by the dashed boxes 142, for instance, to supportively space the RIS 120 from the radiators at a known distance.

In operation, the radiators 110 can emit electromagnetic (EM) waves or signals provided by the feed in both+Z and −Z directions. Waves traveling in the −Z direction will travel along a propagation pathway illustrated by a path arrow P1 downward (relative to FIG. 5), through the gap distance 140 (i.e. through air or a dielectric 141, 142), and reach the RIS 120. The waves will then further be absorbed by the patches 130 (not shown in FIG. 5), resulting in current flowing through the set of metal posts 128 (along the distance 136) to the conductive sheet 126. The current will flow to the conductive sheet 126, and return back in a similar traversing pathway illustrated by a path arrow P2, e.g. through the set of metal posts 128, to the patches 130 of the RIS 120, radiate or emissive travel upward (relative to FIG. 5) through the air gap or dielectric 141, 142, and through the radiators in the +Z direction. The resulting phase shift contributions from at least the reflection or round-trip pathway, can be substantially in-phase with the EM waves or signals emitted from the radiators 110 in the +Z direction (illustrated by another path arrow P3). It is contemplated that "substantially in-phase" can include a total phase shift between the emitted+Z waves and the reflected+Z waves can be nearly 0 degrees, or sufficiently small e.g. ±45 degrees, such that the two waves can constructively interfere. Waves traveling in the X- or Y-directions can be damped by the RIS 120, as the hexagonal-patterned patches 130 aligned in the X-Y plane can form a high surface impedance to wave propagation in these directions. Thus, the propagation pathway from the set of radiators 110 can include the first (e.g. −Z) direction (P1) as well as the resulting reflection of the electromagnetic signal from the conductive sheet 126 to the RIS 120 in a second (e.g. +Z) direction (P2). In this manner, the CP antenna 102 can emit radiation in the desired+Z direction with low backlobe radiation.

It is contemplated that at least one of the gap distance 140 or dielectric with known constant $D_k$ can be selected to define a first electromagnetic wave propagation characteristic, such as a first phase shift of −10 degrees. Furthermore, it is also contemplated that the layer distance 136 can be selected (e.g. by selecting a length of the metal posts 128) to define a second electromagnetic wave propagation characteristic such as a second phase shift of +20 degrees. Note that the first phase shift occurs as the wave propagates in the −Z direction as well as in the +Z direction to provide a total phase shift of −20 degrees. In this manner, the first and second electromagnetic wave propagation characteristics are selected such that the propagation pathway (illustrated by the path arrow P1) modifies the phase of the propagated electromagnetic signal so that the resulting phase of the signal following path P1 experiences a net phase shift of approximately 0 degrees before recombining with the signal of path P1. This technique provides a much wider bandwidth for in-phase combining compared to the application of EBG.

Figure 6:
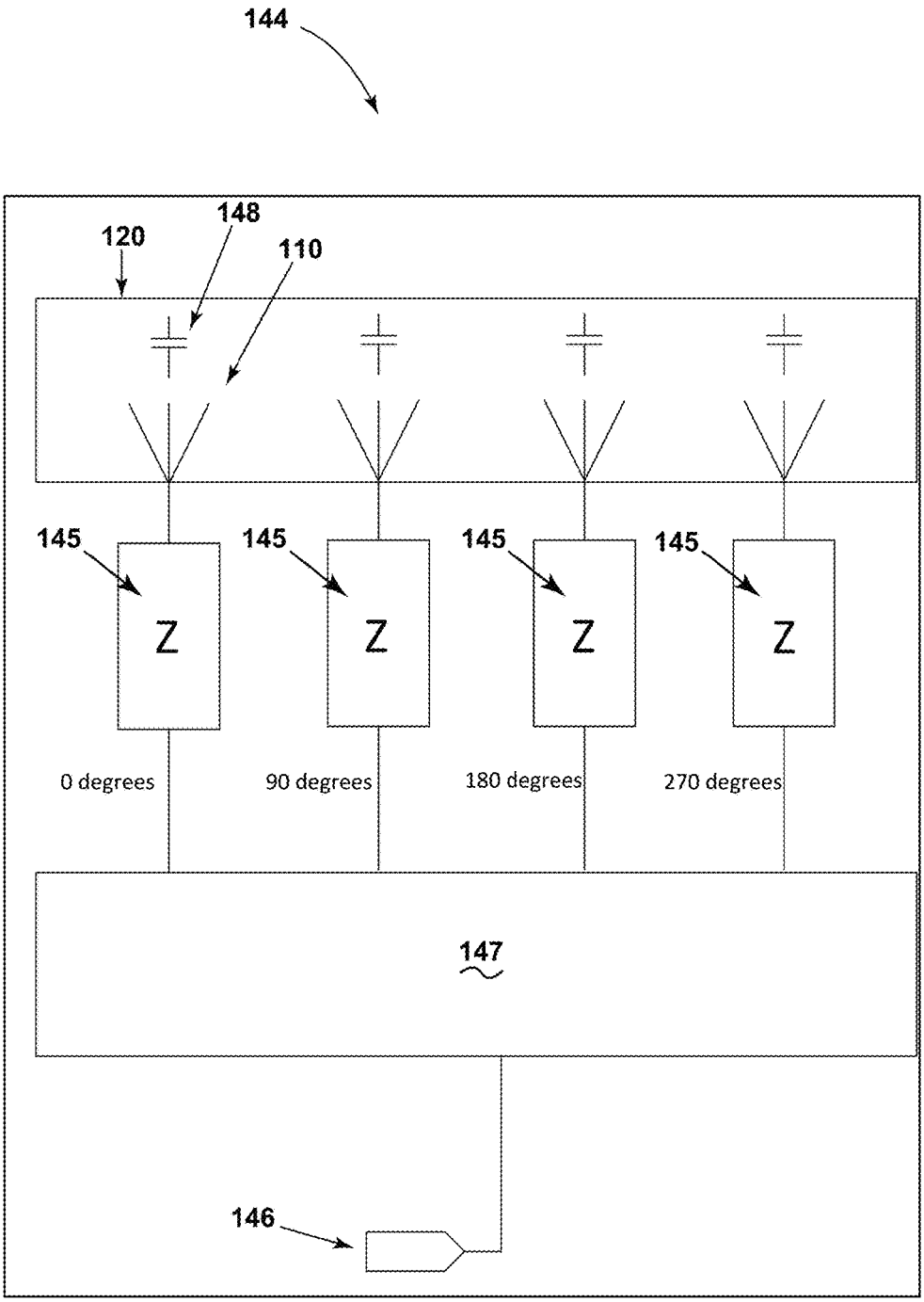
FIG. 6 is a schematic view illustrating an electrical block diagram for the circularly polarized antenna of FIG. 3 including a simultaneous element impedance matching (SEIM) circuit.

Turning to FIG. 6, an electrical block diagram is illustrated for an impedance matching circuit 144 that can be utilized in the CP antenna 102. In many cases, antenna operating bandwidth is improved by including circuit elements between the radiating structure and the feed structure. Designing the matching circuit can include measuring the impedance of the radiating element as well as the feed circuit, and determining the circuit elements to interface them with minimum reflected power.

All of the radiators 110 of the CP antenna 102 are fed simultaneously by the feed structure 115, and as such, impedance presented by an individual radiator 110 will be affected by radiated fields that are coupled from the other radiators 110. In prior art CP antennas, this effect is typically ignored as the coupling between radiating elements can be relatively weak, though interface circuitry performance can be reduced as a result. It can be appreciated that the radiators 110 in the CP antenna 102 are in close proximity compared with prior art antennas, and further, that the RIS can increase coupling effects between the radiators 110. It can therefore be beneficial to utilize a simultaneous element impedance matching (SEIM) circuit 145 to reduce reflected power loss at the interface connection 116 between radiators 110 and feed network (not shown) within the CP antenna 102.

The impedance matching circuit 144 includes an input connection 146 that provides a connection to a network 147. More specifically, each radiator 110 can be connected to a dedicated SEIM circuit 145, and the network 147 can be configured to provide equal-amplitude, 0/90/180/270 phase-shifted signals relative to the input connection 146 signal received and provided, respectively, to the SEIM circuits 145. The radiators 110 can have substantial capacitive coupling (illustrated with capacitors 148) due to the large area above the RIS 120.

Figure 7:
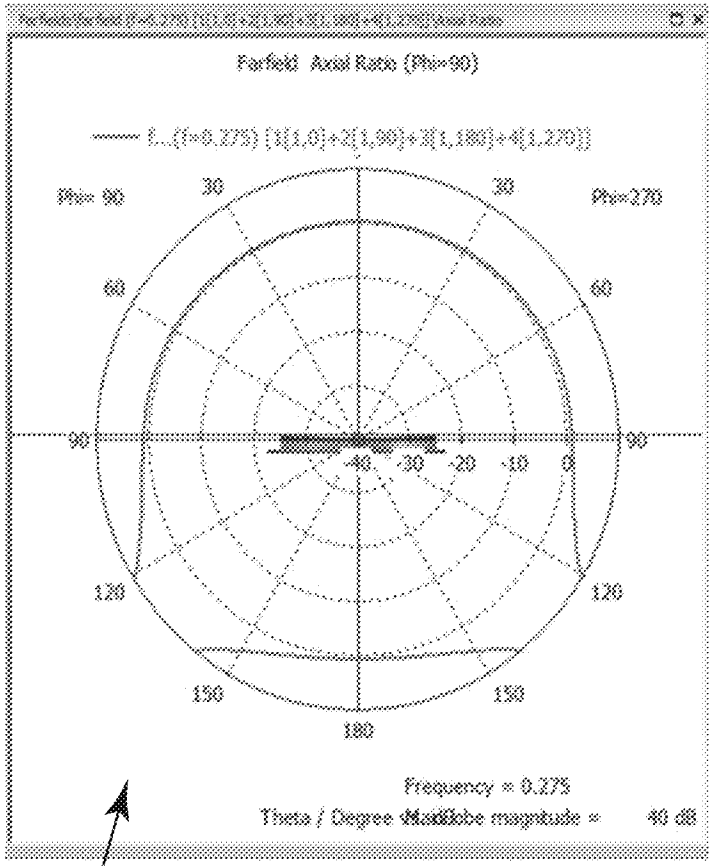
FIG. 7 illustrates plot graphs of a radiation pattern and an axial ratio pattern of the circularly polarized antenna of FIG. 2.
Figure 7:
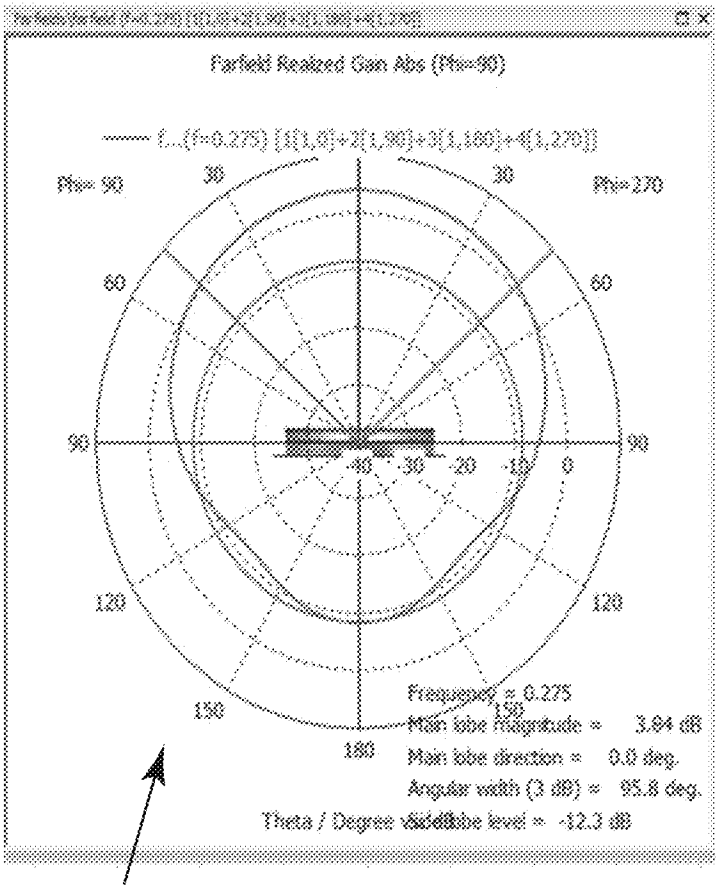

FIG. 7 shows an exemplary two-dimensional radiation pattern 150 and an exemplary axial ratio pattern 152 for the CP antenna 102 of FIG. 2. In the example shown, the main lobe magnitude is approximately 3.8 dB while the back lobe magnitude is approximately −9 dB. The physical construction of the CP antenna 102 has a high degree of radial symmetry, and it can be further appreciated that this can result in a nearly 1:1 axial ratio (i.e. 0 dB) over the intended direction of propagation from +90 to −90 degrees.

Figure 8A:
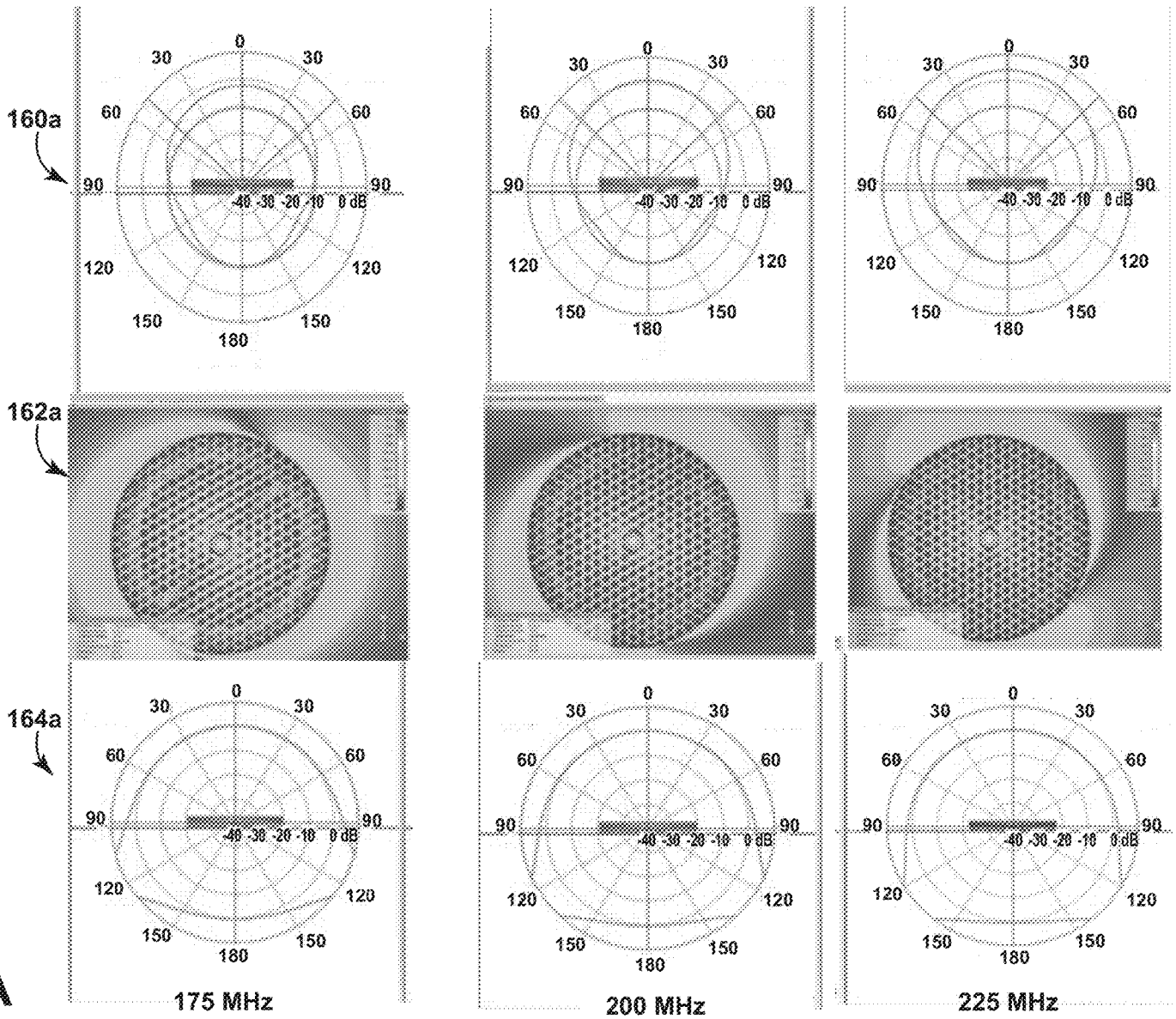
FIG. 8A illustrates tangential electric fields within the RIS of FIG. 3 in a first configuration over a first range of frequencies with corresponding radiation patterns and axial ratio patterns.
Figure 8B:
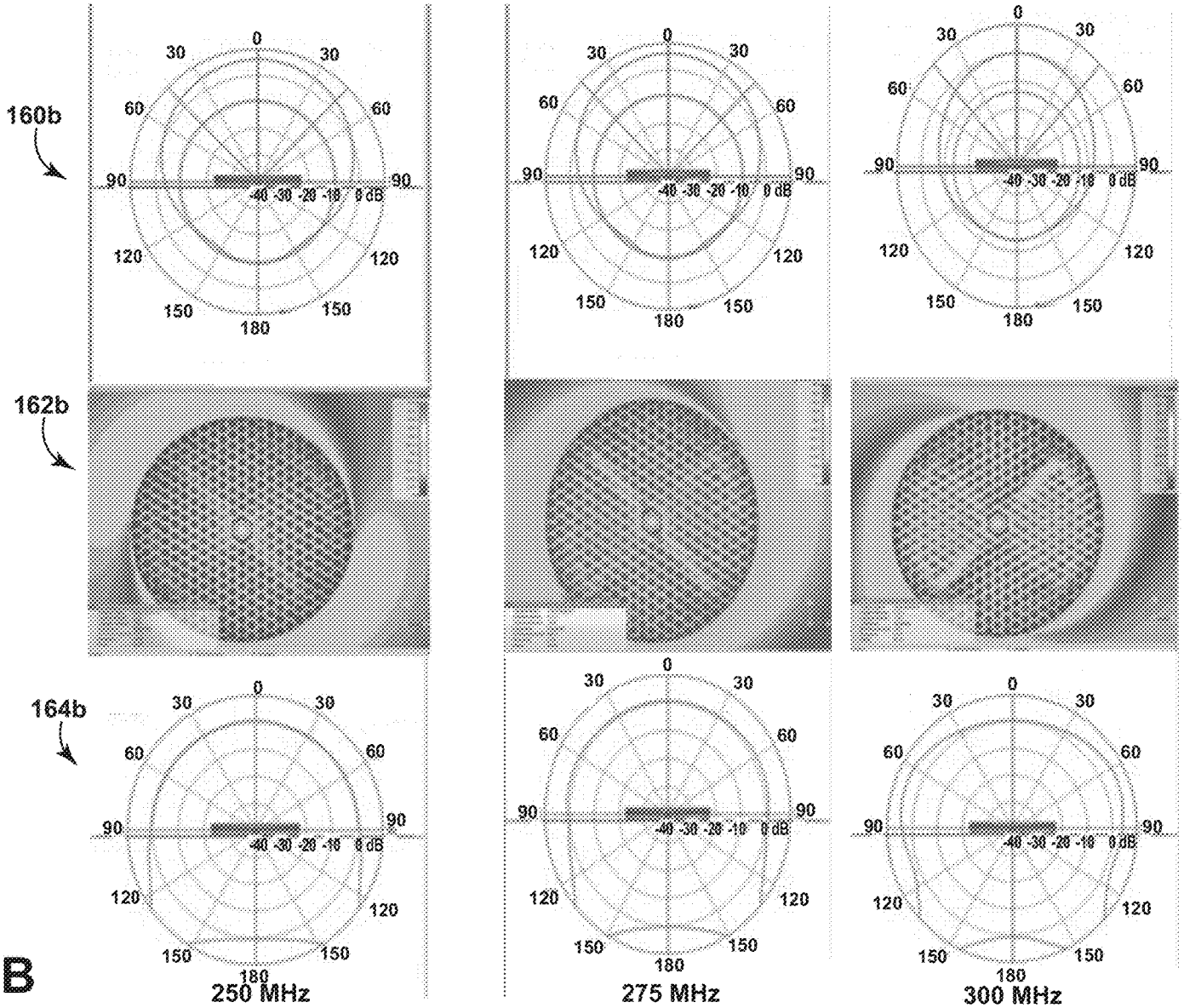
FIG. 8B illustrates tangential electric fields within the RIS of FIG. 3 in a first configuration over a second range of frequencies with corresponding radiation patterns and axial ratio patterns.

FIGS. 8A and 8B illustrate respective sets of exemplary radiation patterns 160A, 160B, surface electric fields 162A, 162B along the RIS 120, and axial ratio patterns 164A, 164B over a stepped frequency range of 175-300 MHz. More specifically, the exemplary patterns 160A, 160B, 164A, 164B and fields 162A, 162B are provided for a 643 mm diameter RIS 120 with a 480 mm diameter support layer 117. The bandwidth of operation of the RIS is defined by a frequency range where it effectively reduces the surface currents. Outside of this range, surface currents are relatively high near the perimeter of the RIS resulting a poor axial ratio and higher back lobe. The lower limit exists because the surface impedance of the RIS decreases with frequency thereby reducing the effectiveness of extinguishing surface currents. The upper limit exists because the coupling between RIS and the radiators becomes resonant thereby allowing high surface currents to flow.

It can be appreciated that over this frequency range the main lobe magnitude is stronger than the back lobe magnitude by at least 10 dB. In addition, the axial ratio is very nearly the ideal 1:1, i.e. 0 dB, over a wide range of directional angles at all frequencies shown here.

Figure 9A:
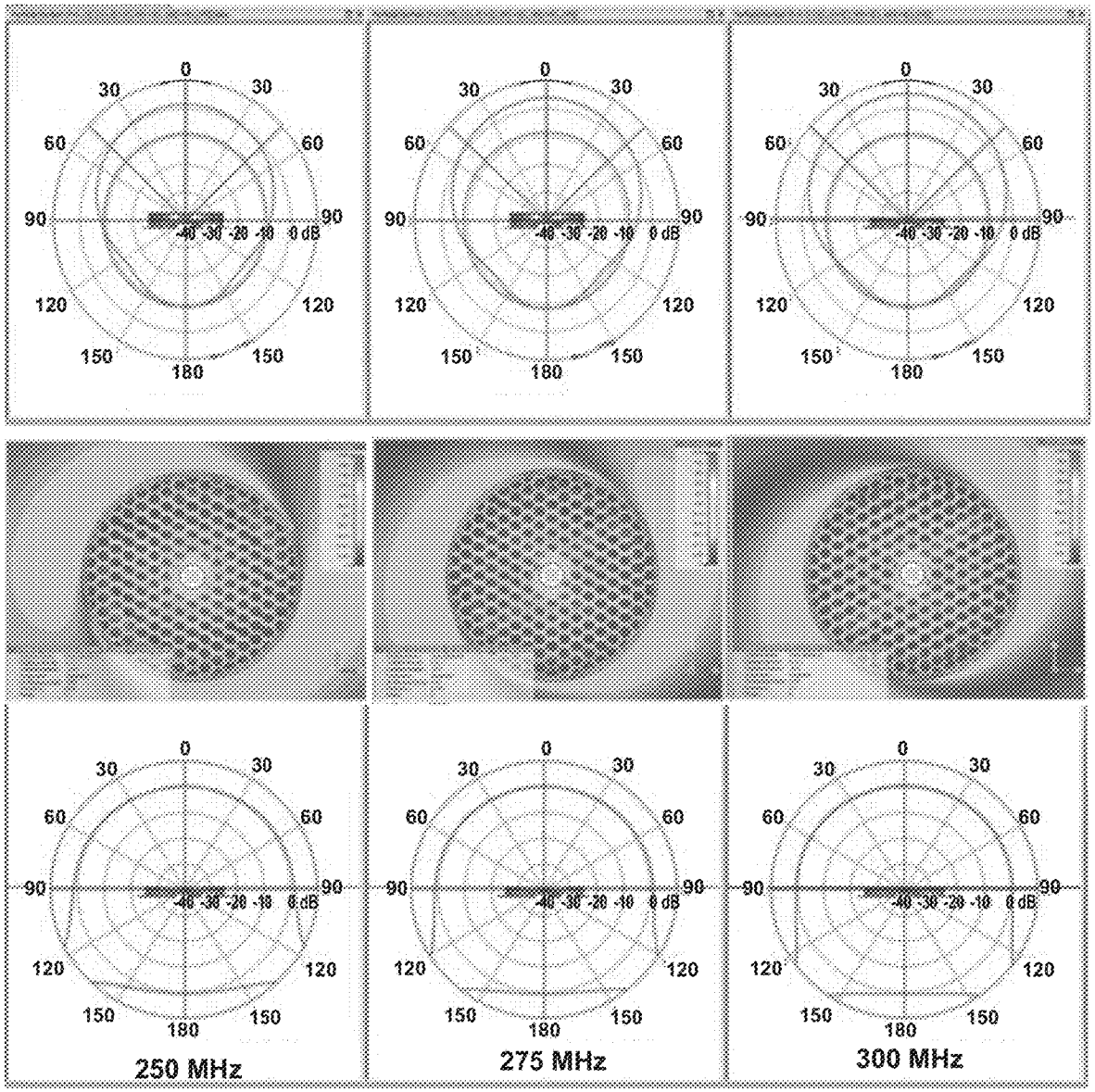
FIG. 9A illustrates tangential electric fields within the RIS of FIG. 3 in a second configuration over a first range of frequencies with corresponding radiation patterns and axial ratio patterns.
Figure 9B:
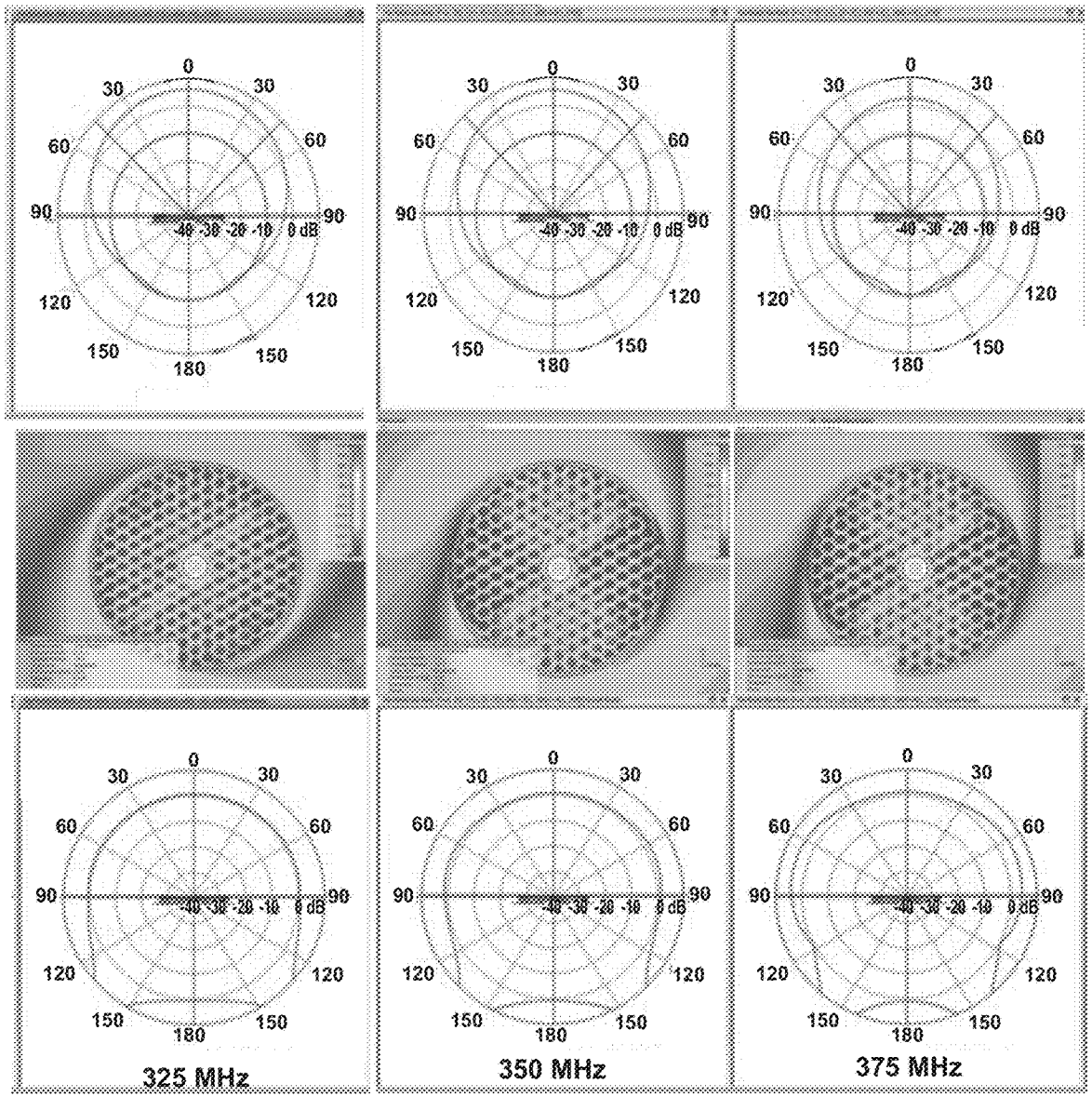
FIG. 9B illustrates tangential electric fields within the RIS of FIG. 3 in a second configuration over a second range of frequencies with corresponding radiation patterns and axial ratio patterns.

FIGS. 9A and 9B illustrate respective sets of exemplary radiation patterns 170A, 170B, surface electric fields 172A, 172B along the RIS 120, and axial ratio patterns 174A, 174B for a 343 mm diameter RIS 120 with a 480 mm diameter support layer 117, and over a higher frequency range of 250-375 MHz. Here, the coupling between the radiators 110 and RIS 120 is reduced, resulting in a higher resonant frequency. The high-frequency limit is generally associated with high surface electric fields reaching the edge of the RIS 120. At or near this limit, the axial ratio diverges from ideal (0 dB), the radiation pattern has a stronger back lobe component (i.e. near 180 degrees), and surface currents are relatively high at the edge of the RIS 120.

Figure 10:
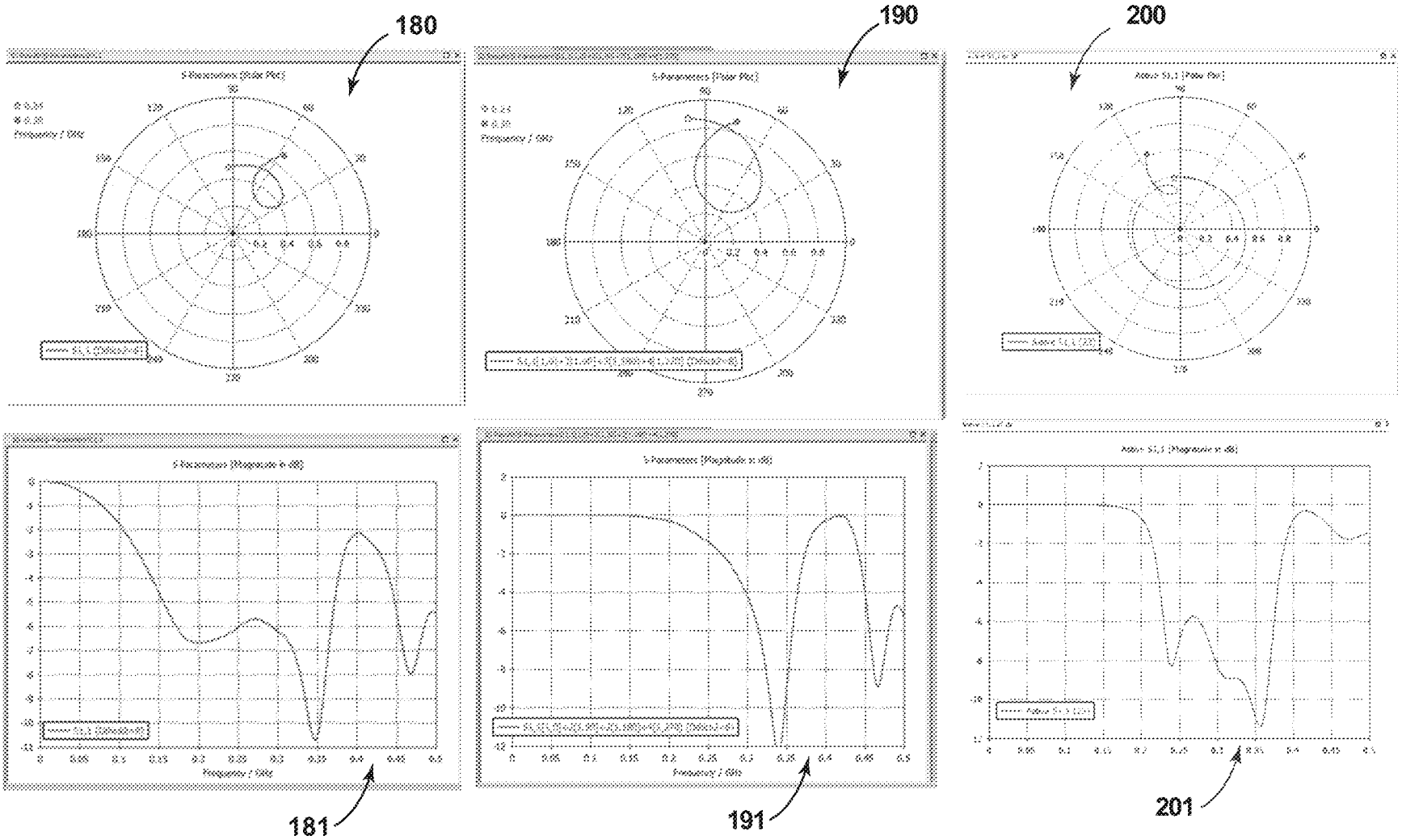
FIG. 10 illustrates plot graphs of element input impedance with and without the SEIM circuit of FIG. 6, as well as after inclusion of an interface circuit.

FIG. 10 illustrates plotted impedance and return losses based on single-element and simultaneous-element excitation. A polar plot 180 illustrates the impedance of a single excited radiator element, such as one of the radiators 110 of FIG. 3. Plot 181 illustrates the associated return loss for the radiator element. A second polar plot 190 illustrates the impedance of all radiator elements 110 when all are simultaneously excited at their appropriate respective phase of 0/90/180/270 degrees; the associated return loss is shown in the associated plot 191. It can be appreciated that the presence of other radiating elements can alter the measured impedance of the single radiator element.

A third polar plot 200 illustrates a single-element impedance when all radiator elements 110 are simultaneously excited at their appropriate respective phase of 0/90/180/270 degrees, with impedance modified by the SEIM circuit 145 of FIG. 6. Without the SEIM circuits 145, the performance shown in 190 and 191 is compromised, allowing approximately 33% of the power to transfer into the radiators at the worst case frequency (240 MHz). It can be appreciated from the plots 200, 201 that the addition of SEIM circuits 145 can provide for 75% power transfer at the worst case frequency (approximately 255 MHz).

Figure 11:
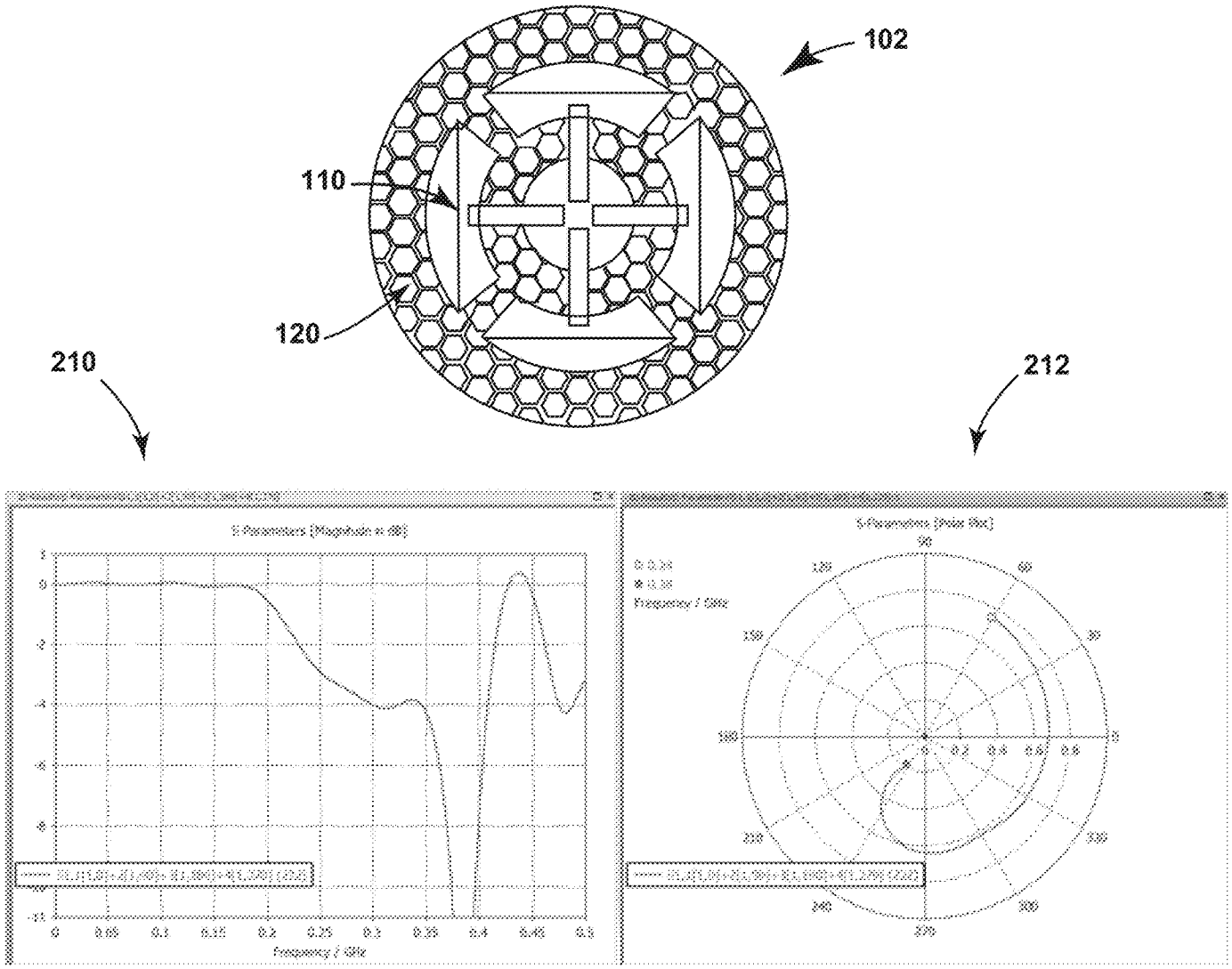
FIG. 11 illustrates radiators of the circularly polarized antenna of FIG. 2, as well as a plot graph of an associated graphs of S parameters.

Turning to FIG. 11, the CP antenna 102 is illustrated with the radiators 110 visible in one example. Exemplary return loss and impedance plots 210, 212 are illustrated for the CP antenna 102 under a preselected set of operating conditions such as frequency.

Figure 12:
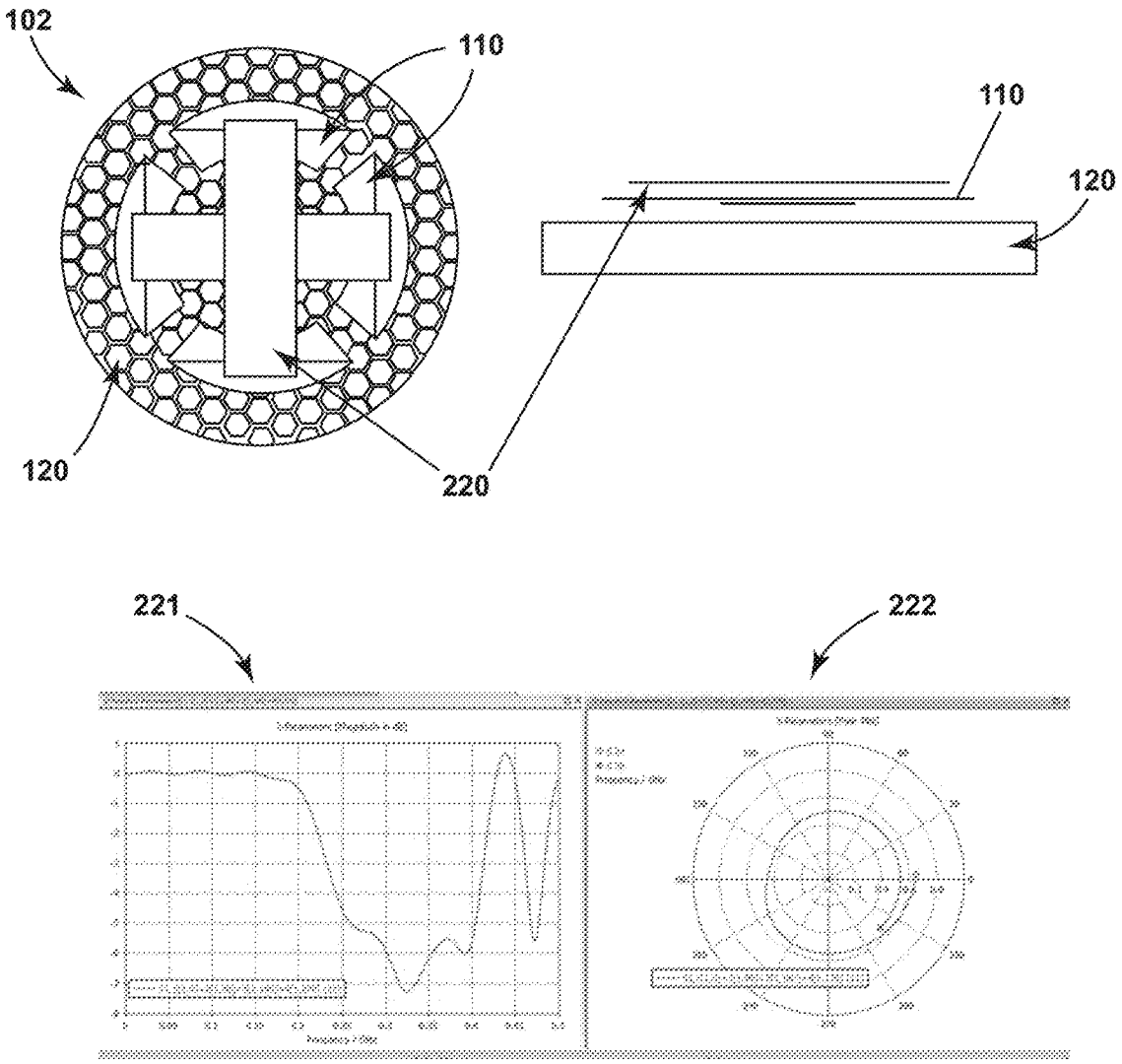
FIG. 12 illustrates the radiators of FIG. 13 with additional parasitic radiators, as well as plot graphs of associated S parameters.

Referring now to FIG. 12, additional radiators known as parasitic radiators 220, can be added to the radiators 110 of FIG. 11. These parasitic radiators 220 modify the impedance presented by the radiators 110 by coupling to the radiators 110, and associated return loss and impedance plots 221, 222 are shown for the configuration including the parasitic radiators 220. The modified impedance can be advantageous by allowing more power to be transferred to the radiators 110 as compared to the example of FIG. 11, and so allowing a simpler SEIM circuit (not shown). As used herein, a "simpler" SEIM circuit refers to one that requires less electrical components such as inductors or capacitors. Adding parasitic radiators 220 above the radiators 110 can modify the impedance providing lower reflection loss, which also supports a potentially simpler SEIM circuit. Many alternative parasitic arrangements are possible, include the addition of parasitic radiators 220 adjacent to the radiators 110, or rotated to be positioned between adjacent radiators 110.

Figure 13:
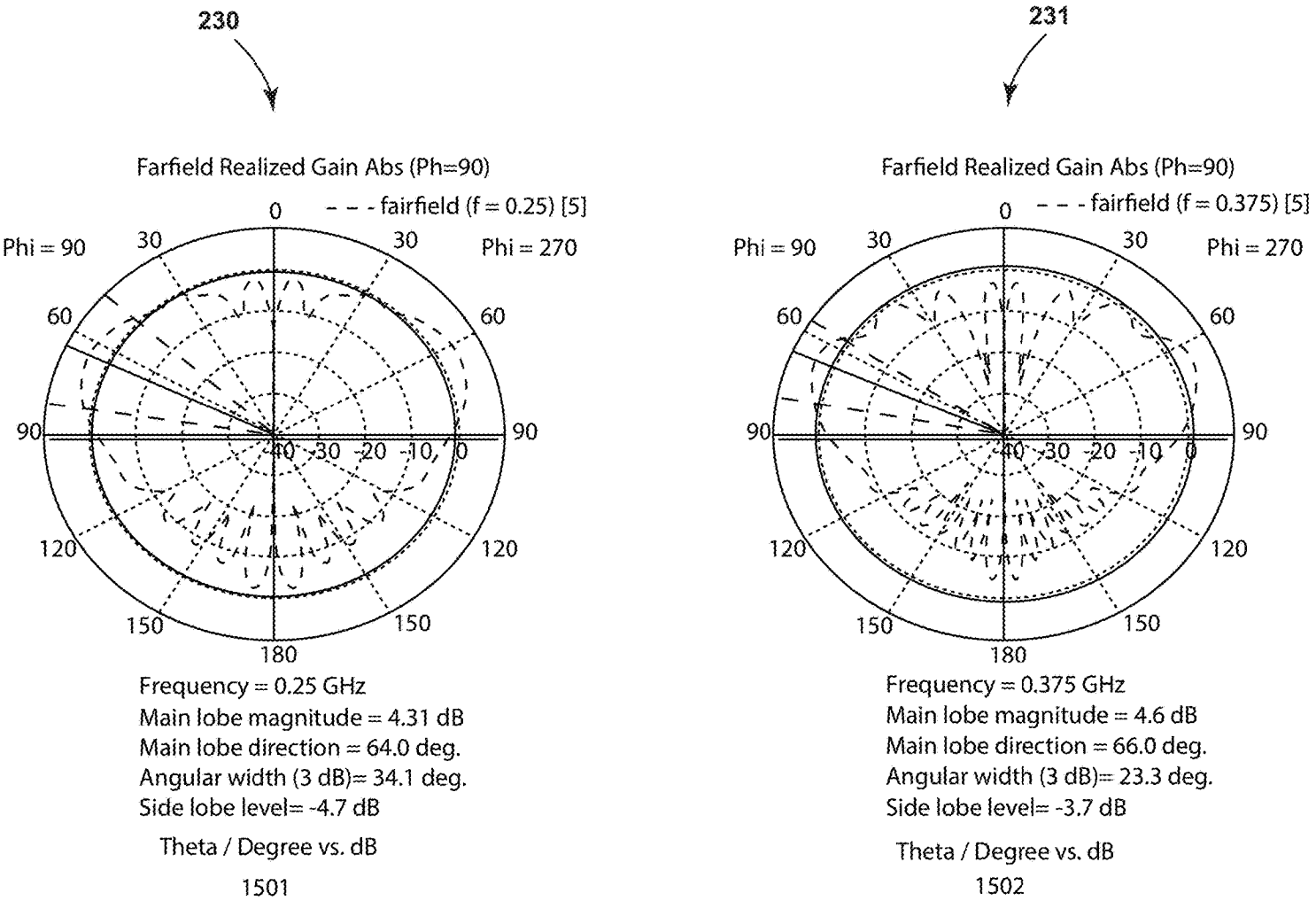
FIG. 13 (Prior Art)
FIG. 13 is a plot illustrating a radiation pattern of a prior art vertically-polarized antenna.

FIG. 13 shows radiation patterns for a prior art vertically polarized antenna, such as that housed within the vertical housing 14 of FIG. 1. In the example shown, the vertical housing 14 is positioned above a 6-meter-diameter ground plane at a relatively low frequency, as shown in the gain plot 230, and at a relatively high frequency as shown in the gain plot 231. Multiple lobes and sharp nulls can be observed, notably in the higher frequency gain plot 231.

Figure 14:
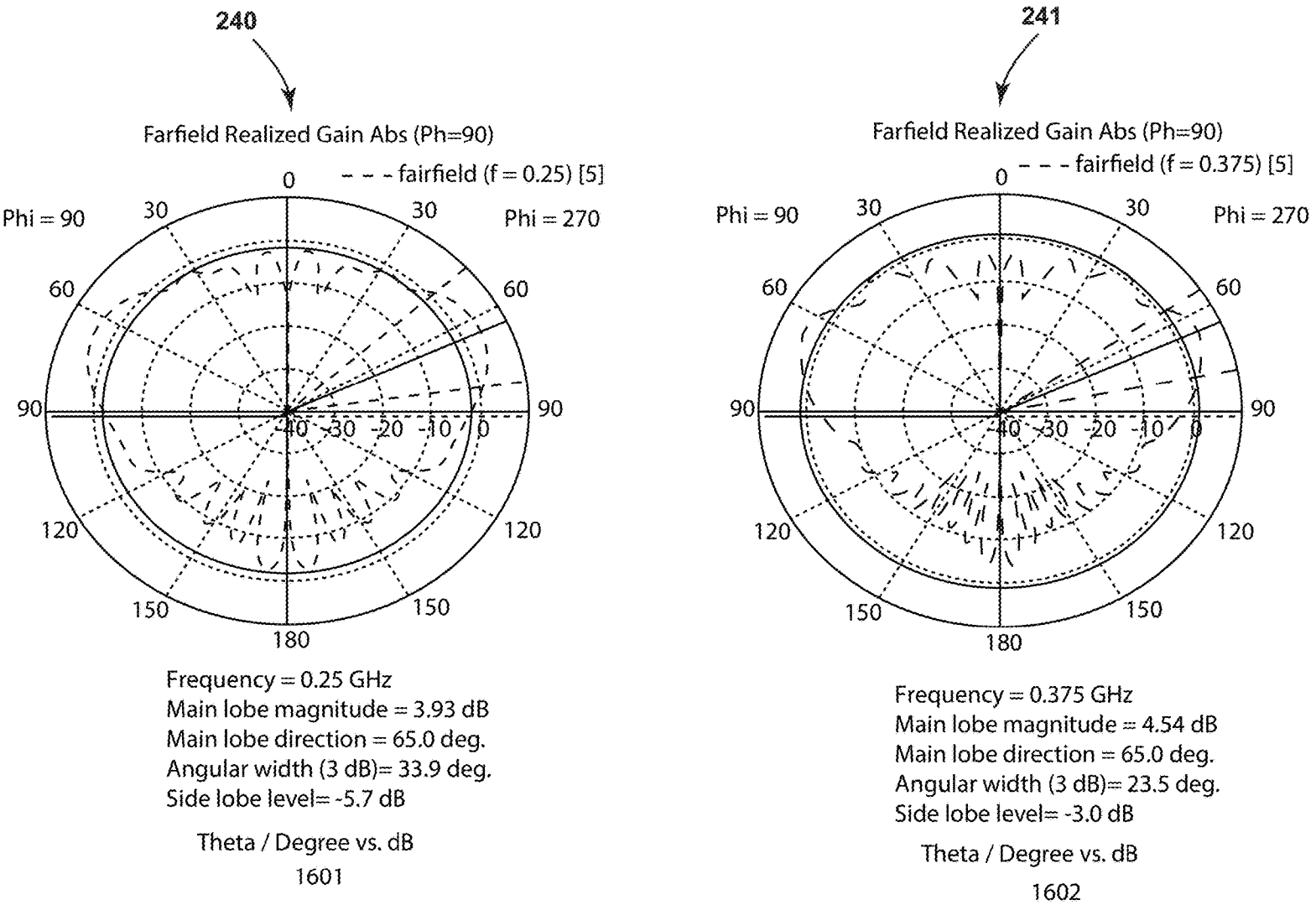
FIG. 14 is a plot illustrating a radiation pattern of a vertical antenna in the antenna assembly of FIG. 2.

FIG. 14 shows radiation patterns for the vertically polarized antenna 105 mounted above the exemplary low profile SATCOM antenna (CP antenna) 102 of FIG. 2. In the example shown, the vertical antenna housing 104 is positioned above a 6-meter-diameter ground plane at a relatively low frequency, as shown in the gain plot 240, and at a relatively high frequency as shown in the gain plot 241. It can be appreciated the exemplary low-profile SATCOM antenna 102 provides a smoother pattern, observed in the gain plots 240, 241, when compared with the gain plots 230, 231 of the prior art shown in FIG. 13.

Figure 15:
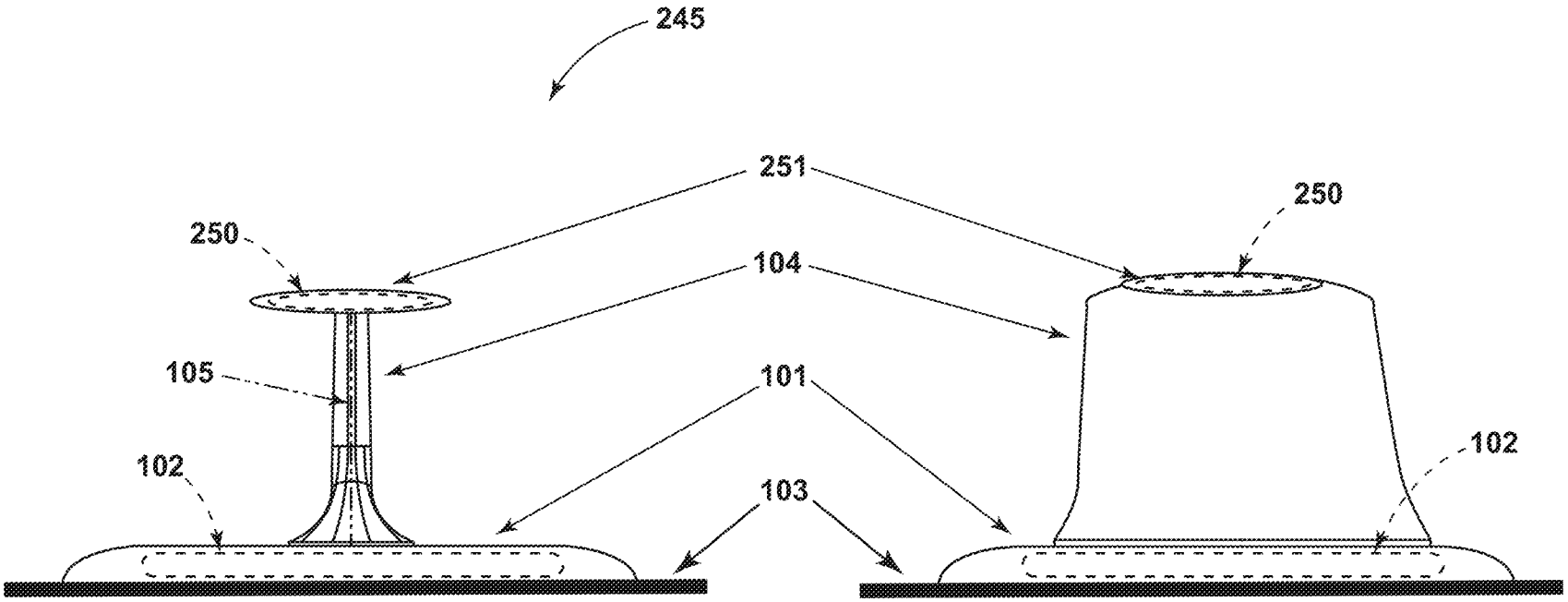
FIG. 15 illustrates a front and side view of another antenna assembly in accordance with various aspects described herein.

In addition to the vertical antenna, a second or smaller CP antenna is often combined into antenna housings as needed, such as for Global Position System (GPS) signal reception. Turning to FIG. 15, another non-limiting aspect of the disclosure is illustrated wherein another antenna assembly 245, similar to the antenna assembly 100 unless otherwise noted, includes a second CP antenna 250 parallel with the CP housing 101, and connected with the distal end 107 of the vertical housing 104. The vertical antenna housing 104 is set above the low-profile SATCOM antenna housing (CP housing) 101, and above the mounting surface 103, such as the aircraft body or exterior wall. The vertical housing 104 naturally supports the inclusion of a small second CP antenna 250 above the vertical antenna 105, as might be used for GPS. The top surface of the housing 104 can thus be utilized to support a small housing 251 having a generally round shape for the second CP antenna 250. In another example, the vertically polarized antenna can be omitted such that the smaller second CP antenna 250 could be set closer to the larger CP antenna 102.

Aspects of the present disclosure provide for a variety of benefits. In one example, the CP antenna as described herein can operate over at least a 55% percent bandwidth with a smaller height compared to the prior art. The RIS operates with high gain and low axial ratio as seen in FIG. 7, and performs acceptably over at least a 2:1 bandwidth as seen in FIGS. 8-9. The RIS 120 can be optimized to the round perimeter of the dipole antenna shape to create a low-profile antenna with efficient size.

Since aspects of the disclosure can allow a much lower-profile CP SATCOM antenna, the vertical antenna can be incorporated above the SATCOM antenna such as in the environment of an aircraft SATCOM antenna. This provides the benefit of much lower wind loading, as air currents naturally draft around the low-profile surface. It can be further appreciated that the SATCOM antenna housing naturally provides for a larger attachment area to its mounting surface compared the vertical antenna housing, thus providing a fundamentally stronger interface to the mounting surface such as vehicle or aircraft environments. In this sense, the lower profile can reduce the exposure of the SATCOM antenna to the airstream. An additional benefit can be found in the behavior of the RIS proximate the mounting surface; as the RIS can reduce surface currents on the mounting surface (e.g. aircraft body), such a reduction can further improve the radiation pattern such as by smoothing the pattern compared to prior art antenna assemblies.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An antenna assembly, comprising:
- a circularly polarized antenna housing configured to mount to a mounting surface; and
- a vertical antenna housing having a first end proximate to the circularly polarized antenna housing and a distal end extending normally from the circularly polarized antenna housing; and
- a second antenna housing parallel with the circularly polarized antenna housing, and connected with the distal end of the vertical antenna housing;
- wherein the vertical antenna housing is spaced opposite of the mounting surface by the circularly polarized antenna housing.

2. The antenna assembly of claim 1, further comprising a circularly polarized antenna having:
- a set of radiators;
- a feed structure connected with the set of radiators and configured to transmit an electromagnetic signal to the set of radiators;
- a reactive impedance surface (RIS) positioned parallel with the radiators; and
- a conductive surface connected with the RIS by a set of posts.

3. The antenna assembly of claim 2 wherein conductive surface is spaced from the set of radiators by the RIS.

4. The antenna assembly of claim 2, further comprising a dielectric positioned between the radiators and the RIS and defining a gap distance between radiators and the RIS.

5. The antenna assembly of claim 4 wherein at least one of the gap distance or dielectric is selected to define a first electromagnetic wave propagation characteristic.

6. The antenna assembly of claim 5 wherein the set of posts space the conductive surface from the RIS.

7. The antenna assembly of claim 6 wherein a length of the set of posts is selected to define a second electromagnetic wave propagation characteristic.

8. The antenna assembly of claim 7 defining a propagation pathway of an electromagnetic signal from the set of radiators in a first direction, along the gap distance to the RIS, and from the RIS through the set of posts to the conductive surface, and a resulting reflection of the electromagnetic signal from the conductive surface to the RIS through the set of posts and along the gap distance.

9. The antenna assembly of claim 8 wherein the first and second electromagnetic wave propagation characteristics are selected such that the propagation pathway modifies a phase of the propagated electromagnetic signal, and wherein the propagated electromagnetic signal is in-phase with an electromagnetic signal propagated from the set of radiators in a second direction, opposite of the first direction.

* * * * *